US012011087B1

(12) United States Patent
Liu

(10) Patent No.: US 12,011,087 B1
(45) Date of Patent: Jun. 18, 2024

(54) SHELF DEVICE AND SHELF UNIT THEREOF

(71) Applicant: TAIWAN SHIN YEH ENTERPRISE CO., LTD., Chia Yi Hsien (TW)

(72) Inventor: Hung-Tsun Liu, Chiayi (TW)

(73) Assignee: TAIWAN SHIN YEH ENTERPRISE CO., LTD., Chia Yi Hsien (TW)

( * ) Notice: Subject to any disclaimer, the term of this patent is extended or adjusted under 35 U.S.C. 154(b) by 0 days.

(21) Appl. No.: 18/304,041

(22) Filed: Apr. 20, 2023

(51) Int. Cl.

| | |
|---|---|
| ***A47B 57/40*** | (2006.01) |
| ***A47B 47/00*** | (2006.01) |
| ***A47B 47/02*** | (2006.01) |
| ***A47B 87/00*** | (2006.01) |
| ***A47B 87/02*** | (2006.01) |
| ***A47B 96/14*** | (2006.01) |

(52) U.S. Cl.
CPC ..... *A47B 57/40* (2013.01); *A47B 47/0083* (2013.01); *A47B 47/028* (2013.01); *A47B 87/008* (2013.01); *A47B 87/0207* (2013.01); *A47B 96/1458* (2013.01)

(58) Field of Classification Search
CPC ... A47B 57/40; A47B 87/008; A47B 87/0207; A47B 47/0083; A47B 47/045; A47B 47/0091; A47B 47/02; A47B 47/027; A47B 47/028; A47B 57/16; A47B 57/22; A47B 57/20; A47B 57/48; A47B 57/50; A47B 87/0215; A47B 87/0223; A47B 87/0246; A47B 87/0253; A47B 87/0276; A47B 96/145; A47B 96/1458; A47B 96/1408
USPC ..... 211/189, 194, 188, 191
See application file for complete search history.

(56) References Cited

U.S. PATENT DOCUMENTS

| | | | | | |
|---|---|---|---|---|---|
| 3,465,898 | A * | 9/1969 | Klein | A47B 87/0215 | 211/188 |
| 3,506,138 | A * | 4/1970 | Travis | A47B 55/02 | 108/53.5 |
| 3,765,541 | A * | 10/1973 | Madey | A47B 47/00 | D6/702 |
| 3,802,574 | A * | 4/1974 | Weider | B65G 1/02 | 108/187 |
| 3,811,575 | A * | 5/1974 | Boegehold | A47F 5/10 | 248/245 |
| 4,056,180 | A * | 11/1977 | Gunti | B65G 13/11 | 198/860.3 |
| 4,265,501 | A * | 5/1981 | Halliburton | A47B 43/00 | 312/258 |

(Continued)

*Primary Examiner* — Jennifer E. Novosad
(74) *Attorney, Agent, or Firm* — Muncy, Geissler, Olds & Lowe, P.C.

(57) ABSTRACT

A shelf unit includes four leg rods and two assembly mechanisms. The leg rods extend in an up-down direction, are spaced apart from each other, and are equally divided into two leg pairs. Each of the assembly mechanisms includes a first connecting subunit that is mounted to a top end of a respective one of the leg pairs, and a second connecting subunit that is mounted to a bottom end of the respective one of the leg pairs. One of the first and second connecting subunits of each of the assembly mechanisms has two engaging holes each of which is configured to be non-circular. The other one of the first and second connecting subunits of each of the assembly mechanisms has two through holes each of which corresponds in position to a respective one of the engaging holes of the assembly mechanism in the up-down direction.

5 Claims, 6 Drawing Sheets

(56) References Cited

U.S. PATENT DOCUMENTS 4,940,149 A * 7/1990 Vineis ..... F16B 12/24 211/186
5,743,415 A * 4/1998 Smart ..... A45D 20/12 248/314
5,918,750 A * 7/1999 Jackson ..... A47F 5/0807 108/108
6,102,219 A * 8/2000 Wang ..... A47B 87/00 312/111
7,997,213 B1 * 8/2011 Gauthier ..... B65D 88/022 294/67.1
9,144,303 B2 * 9/2015 Eustace ..... B25H 1/12
9,198,324 B1 * 11/2015 Yousif ..... H05K 7/18
9,723,925 B1 * 8/2017 Tsai ..... A47B 45/00
10,238,207 B1 * 3/2019 Schenker ..... A47B 47/027
10,299,588 B1 * 5/2019 Lai ..... A47B 95/00
10,376,047 B1 * 8/2019 Ebbesson ..... A47B 47/0083
10,952,533 B2 * 3/2021 Lert, Jr. ..... B65G 1/065
11,019,921 B2 * 6/2021 Liss ..... A47B 47/028
11,083,289 B2 * 8/2021 Németh ..... F16B 12/40
11,197,542 B2 * 12/2021 Haimoff ..... A47B 87/007
11,214,401 B1 * 1/2022 Emmitt ..... B65D 19/385
11,241,092 B1 * 2/2022 Liu ..... F16B 7/042
2004/0040923 A1 * 3/2004 Wolff ..... A47G 7/041 431/296
2005/0194331 A1 * 9/2005 Chang ..... A63D 15/10 211/60.1
2008/0061019 A1 * 3/2008 Lin ..... A47B 47/0091 211/187
2009/0026155 A1 * 1/2009 Bernard ..... B25H 3/006 248/210
2012/0125870 A1 * 5/2012 Decroos ..... A47F 5/10 211/26
2015/0351533 A1 * 12/2015 Reinhart ..... A47B 96/06 211/188
2016/0095430 A1 * 4/2016 Moyer ..... A47B 47/0091 211/188
2019/0290000 A1 * 9/2019 Davis ..... A47B 96/021
2022/0071389 A1 * 3/2022 Globerman ..... A47B 47/0083
2023/0129296 A1 * 4/2023 Chakraborthy ..... A47B 57/50 211/134
2023/0270248 A1 * 8/2023 Hanlon ..... A47B 47/0083 211/187

* cited by examiner

SHELF DEVICE AND SHELF UNIT THEREOF

FIELD

The disclosure relates to a shelf, and more particularly to a shelf that can be stacked on or juxtaposed with another shelf.

BACKGROUND

To effectively use storage space, people may use shelves to store their belongings. A user may buy a plurality of shelves and arrange them side by side so that the shelves fit into the storage space. Due to conventional shelves on the market not being designed to be assembled with one another, the user may have to tie the conventional shelves that are juxtaposed with pieces of string when the user wants the conventional shelves to be tightly arranged and stable, which is quite inconvenient for the user.

In addition, because the conventional shelves are not designed to be stacked, arrangement of the conventional shelves does not allow for much flexibility, and the storage space may not be well utilized.

SUMMARY

Therefore, an object of the disclosure is to provide a shelf unit that can alleviate at least one of the drawbacks of the prior art.

According to the disclosure, the shelf unit includes a leg rod mechanism, a board mechanism, and two assembly mechanisms. The leg rod mechanism includes four leg rods that extend in an up-down direction and that are spaced apart from each other. The leg rods are equally divided into two leg pairs. The board mechanism is mounted among the leg rods. The assembly mechanisms are respectively mounted to the leg pairs. Each of the assembly mechanisms includes a first connecting subunit that is mounted to a top end of the respective one of the leg pairs, and a second connecting subunit that is mounted to a bottom end of the respective one of the leg pairs. One of the first connecting subunit and the second connecting subunit of each of the assembly mechanisms has two engaging holes each of which extends therethrough in the up-down direction and is configured to be non-circular. The other one of the first connecting subunit and the second connecting subunit of each of the assembly mechanisms has two through holes each of which extends therethrough in the up-down direction and corresponds in position to a respective one of the engaging holes of the assembly mechanism in the up-down direction.

Another object of the disclosure is to provide a shelf device that can alleviate at least one of the drawbacks of the prior art.

According to an aspect of the disclosure, the shelf device includes two shelf units as mentioned above, and four fastening units. The shelf units are stacked in an up-down direction. The leg rods of one of the shelf units are connected to and are located on the leg rods of the other one of the shelf units. The engaging holes of one of the shelf units are respectively aligned with the through holes of the other one of the shelf units in the up-down direction. Each of the fastening units is mounted to a respective one of the engaging holes of the one of the shelf units and a respective one of the through holes of the other one of the shelf units that are aligned in the up-down direction. Each of the fastening units includes a first fastening member that is irrotatably mounted to the respective one of the engaging holes, and a second fastening member that extends through the respective one of the through holes and the respective one of the engaging holes and that is removably connected the first fastening member so that the shelf units are fastened in the up-down direction.

According to another aspect of the disclosure, the shelf device includes two shelf units and two fastening units. The shelf units are arranged side by side. Each of the shelf units includes a leg rod mechanism, a board mechanism, and two assembly mechanisms. The leg rod mechanism includes four leg rods that extend in an up-down direction and that are spaced apart from each other. The leg rods are equally divided into two leg pairs. The board mechanism is mounted to the leg rod mechanism. The assembly mechanisms are mounted to the leg rod mechanism. One of the leg pairs of one of the shelf units is adjacent to one of the leg pairs of the other one of the shelf units so that the shelf units are arranged side by side. The assembly mechanisms of each of the shelf units are respectively mounted to the leg pairs of the shelf unit such that one of the assembly mechanisms of one of the shelf units is adjacent to one of the assembly mechanisms of the other one of the shelf units. Each of the assembly mechanisms includes a first connecting subunit that is mounted to a top end of the respective one of the leg pairs and that has two engaging holes spaced apart from each other. The engaging holes of one of the assembly mechanisms of one of the shelf units are juxtaposed with the engaging holes of one of the assembly mechanisms of the other one of the shelf units. The fastening units are spaced apart from each other. Each of the fastening units is disposed on the first connecting subunits of the adjacent assembly mechanisms of the shelf units so that the shelf units are positioned side by side. Each of the fastening units includes a side fastening member that is mounted to a respective one of the engaging holes of one of the adjacent assembly mechanisms and a respective one of the engaging holes of the other one of the adjacent assembly mechanisms.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
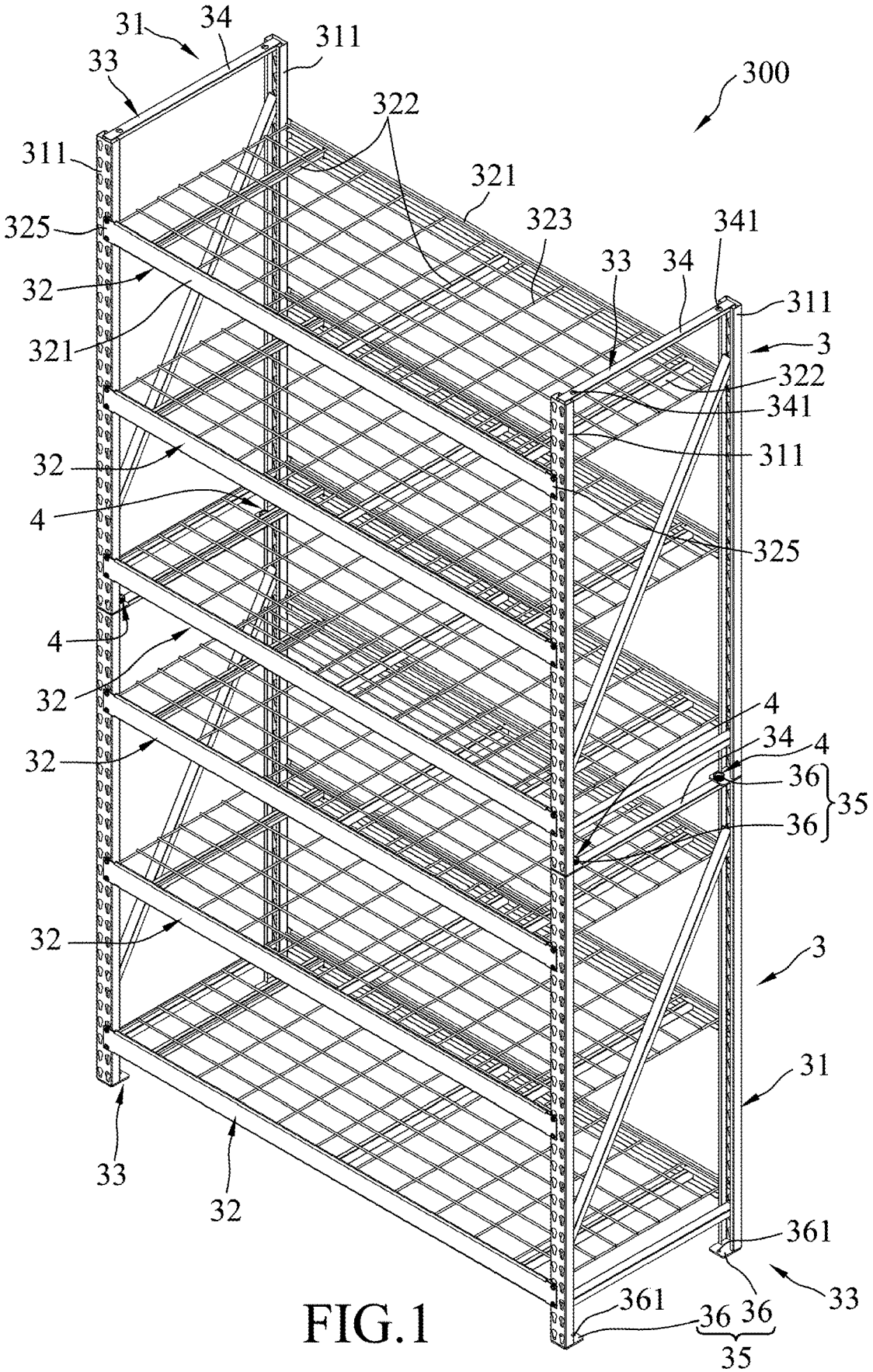
FIG. 1 is a perspective view of a first embodiment of a shelf device according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
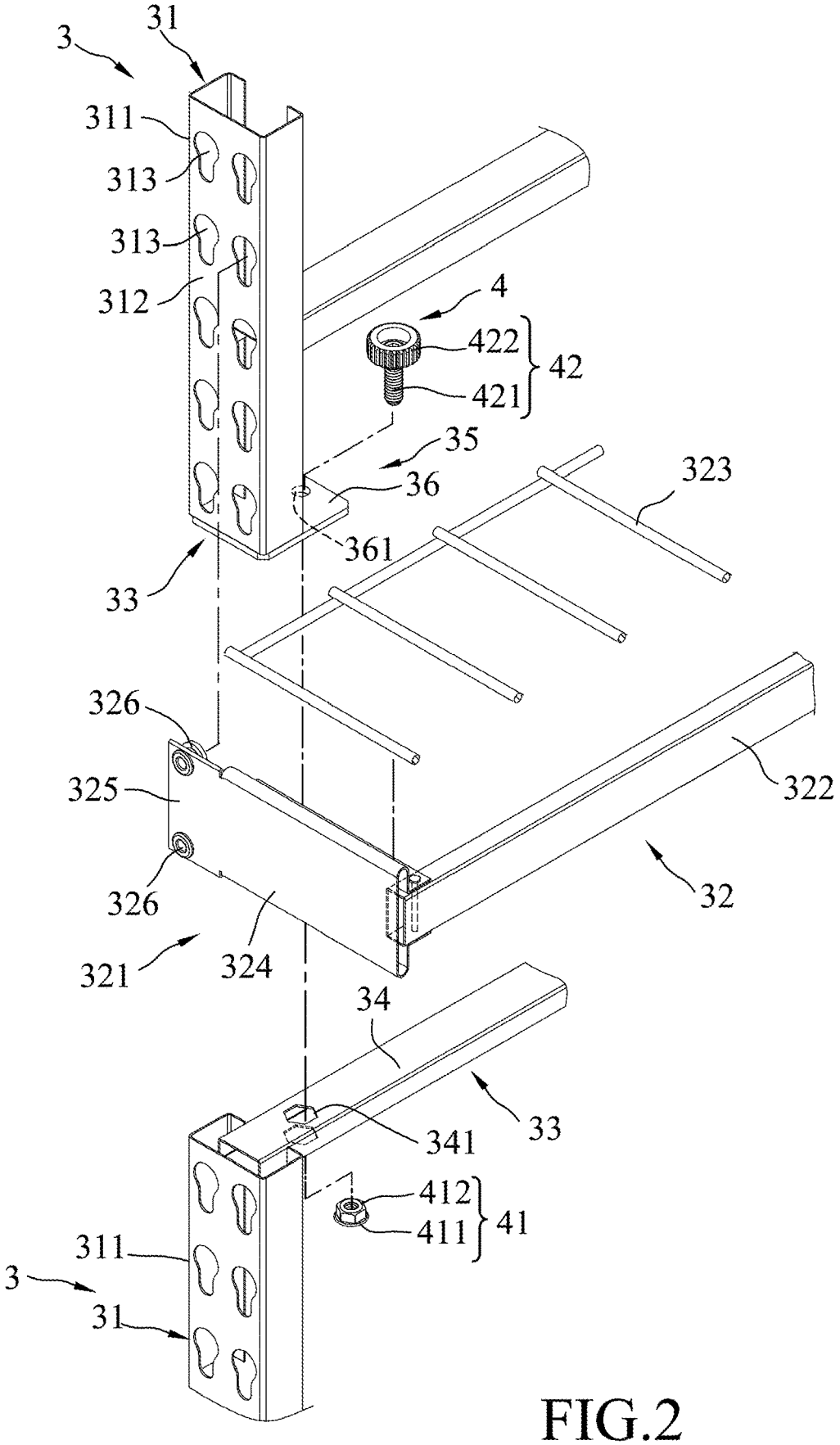
FIG. 2 is a fragmentary, partly exploded perspective view of the first embodiment.
Figure 3:
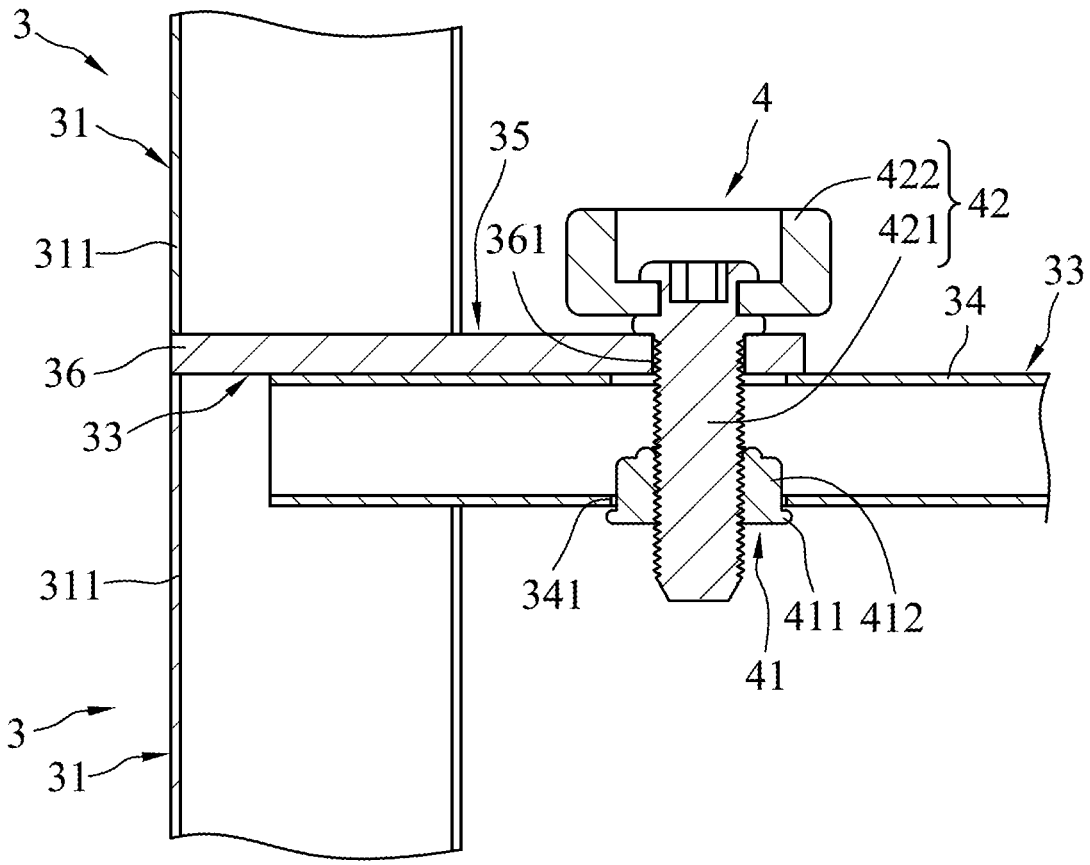
FIG. 3 is a fragmentary sectional view of the first embodiment.

Referring to FIGS. 1 to 3, a first embodiment of a shelf device 300 according to the disclosure includes two shelf units 3 that are stacked in an up-down direction, and four fastening units 4. The fastening units 4 are disposed between the shelf units 3 so that the shelf units 3 are fastened in the up-down direction. Because the structure of each of the shelf units 3 is the same, and because each of the shelf unit 3 is only different in its position, only the upper shelf unit 3 will hereafter be elaborated.

The shelf unit 3 includes a leg rod mechanism 31, three board mechanisms 32, and two assembly mechanisms 33. The board mechanisms 32 are horizontally mounted to the leg rod mechanism 31 and are spaced apart from each other in the up-down direction. The assembly mechanisms 33 are mounted to the leg rod mechanism 31.

The leg rod mechanism 31 includes four leg rods 311 that extend in the up-down direction and that are spaced apart from each other. The leg rods 311 are equally divided into two leg pairs. The leg pairs are spaced apart from each other in a left-right direction orthogonal to the up-down direction. The two leg rods 311 in each of the leg pairs are spaced apart from each other in a front-rear direction orthogonal to the up-down direction and the left-right direction. Each of the leg rods 311 has an engaging wall 312 that extends in the up-down direction and that has a plurality of board engaging portions 313. The board engaging portions 313 of the engaging wall 312 of each of the leg rods 311 are divided into two rows that are arranged in the left-right direction, and the board engaging portions 313 in each row is spaced apart from each other in the up-down direction.

Each of the board mechanisms 32 is mounted among the leg rods 311, and includes two engaging rods 321 that are spaced apart from each other in the front-rear direction and that extend in the left-right direction, three reinforcing rods 322, and a board body 323. One of the engaging rods 321 is removably mounted to a front one of the leg rods 311 in each leg pairs (i.e., front leg rods 311). The other one of the engaging rods 321 is removably mounted to a rear one of the leg rods 311 in each leg pairs (i.e., rear leg rods 311). Each of the reinforcing rods 322 extends in the front-rear direction, is located between the engaging rods 321, and is removably mounted to the engaging rods 321. The board body 323 is removably supported on the engaging rods rods 321 and the reinforcing rods 322. In one embodiment, the board body 323 may be in the form of a grid.

For each board mechanism 32, each of the engaging rods 321 has a supporting portion 324 that supports the board body 323, and two wall engaging portions 325 that are respectively disposed on left and right ends of the supporting portion 324. Each of the wall engaging portions 325 includes two wall engaging members 326 that are spaced apart from each other in the up-down direction. For each board mechanism 32, the wall engaging members 326 of each of the engaging rods 321 protrude toward the other one of the engaging rods 321. The wall engaging members 326 of one of the wall engaging portions 325 of each of the engaging rods 321 removably and respectively engage two of the board engaging portions 313 of one of the leg rods 311 to which the engaging rod 321 is mounted. The wall engaging members 326 of the other one of the wall engaging portions 325 of each of the engaging rods 321 removably and respectively engage two of the board engaging portions 313 of the other one of the leg rods 311 to which the engaging rod 321 is mounted.

The assembly mechanisms 33 are respectively mounted to the leg pairs. Each of the assembly mechanisms 33 includes a first connecting subunit 34 that extends in the front-rear direction and that is mounted to a top end of the respective one of the leg pairs, and a second connecting subunit 35 that is mounted to a bottom end of the respective one of the leg pairs. In the first embodiment, the second connecting subunits 35 of the assembly mechanisms 33 of the upper shelf unit 3 respectively correspond in position to the first connecting subunits 34 of the assembly mechanisms 33 of the lower shelf unit 3 in the up-down direction.

Each of the first connecting subunits 34 is elongated, extends horizontally from a top end of one of the leg rods 311 in the respective leg pair to a top end of the other one of the leg rods 311 in the respective leg pair (i.e., each of the first connecting subunits 34 extends in the front-rear direction), and has two engaging holes 341 each of which extends therethrough in the up-down direction and is configured to be non-circular. In the first embodiment, for each first connecting subunit 34, the engaging holes 341 are spaced apart from each other in the front-rear direction, and each of the engaging holes 341 is hexagonal. Each of the second connecting subunits 35 includes two plate bodies 36 that respectively extend horizontally from the leg rods 311 in the respective leg pair toward each other. Each of the plate bodies 36 has a through hole 361 that extends therethrough in the up-down direction and that is configured to be circular. For each assembly mechanism 33, each of the through holes 361 corresponds in position to a respective one of the engaging holes 341 in the up-down direction. The leg rods 311 of the upper shelf unit 3 are connected to and are located on the leg rods 311 of the lower shelf unit 3. The engaging holes 341 of the lower shelf unit 3 are respectively aligned with the through holes 361 of the upper shelf unit 3 in the up-down direction.

Each of the fastening units 4 is mounted to a respective one of the engaging holes 341 of the lower shelf unit 3 and a respective one of the through holes 361 of the upper shelf unit 3 that are aligned in the up-down direction. Each of the fastening units 4 includes a first fastening member 41 that is irrotatably mounted to the respective one of the engaging holes 341, and a second fastening member 42 that extends through the respective one of the through holes 361 and the respective one of the engaging holes 341, and that is removably connected to the first fastening member 41 so that the second connecting subunits 35 of the upper shelf unit 3 are respectively fastened to the first connecting subunits 34 of the lower shelf unit 3 in the up-down direction.

Each of the first fastening members 41 of the fastening units 4 has an abutting portion 411 that is configured to be disc-shaped, and a fastening portion 412 that extends upwardly from the abutting portion 411, that is irrotatably coupled to the respective one of the engaging holes 341, and that is configured to be hexagonal. The abutting portions 411 of two of the fastening units 4 abut against a bottom side of one of the first connecting subunits 34, and the abutting portions 411 of the other two of the fastening units 4 abut against a bottom side of the other one of the first connecting subunit 34.

Each of the second fastening members 42 of the fastening units 4 has a threaded rod portion 421 that extends through the respective one of the through hole 361 and that is threadedly connected to the fastening portion 412 of a respective one of the first fastening members 41 (i.e., for each fastening unit 4, the threaded rod portion 421 thereof is threadedly connected to the fastening portion 412 thereof), and an operation portion 422 that is connected to a top end of the threaded rod portion 421 and that is operable to urge the threaded rod portion 421 to be threadedly connected to the fastening portion 412 of the respective one of the first fastening members 41.

It is noted that, each of the shelf units 3 may serve as a shelf, but a user may assemble the shelf device 300 by stacking one of the shelf units 3 on the other one of the shelf units 3 and fastening the one of the shelf units 3 to the other one of the shelf units 3 so that the shelf device 300 may serve as a larger shelf. In order to assemble the shelf device 300, when the shelf units 3 are stacked, the first connecting subunits 34 of the lower shelf unit 3 respectively abut against the second connecting subunits 35 of the upper shelf unit 3 in the up-down direction, and the through holes 361 of the second connecting subunits 35 of the upper shelf unit 3 are respectively aligned with the engaging holes 341 of the first connecting subunits 34 of the lower shelf unit 3 (i.e., the through holes 361 of the upper shelf unit 3 are respectively in spatial communication with the engaging holes 341 of the lower shelf unit 3).

Then, the first fastening members 41 are respectively inserted into the engaging holes 341 from the bottom sides of the first connecting subunits 34 such that the first fastening members 41 are respectively mounted to the engaging holes 341. Afterwards, the second fastening members 42 are respectively inserted into the through holes 361 from top sides of the plate bodies 36 such that each of the second fastening members 42 extends through the respective through hole 361 and the respective engaging hole 341 and is threadedly connected to the respective first fastening member 41. Consequently, the shelf units 3 are stacked and are fastened to each other in the up-down direction.

In the first embodiment, the engaging holes 341 are formed at the first connecting subunits 34, and the through holes 361 are formed at the second connecting subunits 35. However, in one embodiment, the engaging holes 341 may be formed at the second connecting subunits 35, and the through holes 361 may be formed at the first connecting subunits 34.

In addition, in the first embodiment, each of the engaging holes 341 is hexagonal, but in one embodiment, each of the engaging holes 341 may be in any shape but a circular shape, as long as the first fastening members 41 may be irrotatably mounted to the engaging holes 341, respectively.

It should be noted that, in the first embodiment, each of the wall engaging portions 325 includes two wall engaging members 326, and for each leg rod 311, each of the board engaging portions 313 is configured to be a hole that extends through the leg rod 311 in the front-rear direction so that one of the wall engaging members 326 of each of the wall engaging portions 325 may removably engage any one of the board engaging portions 313 of the leg rods 311. However, in one embodiment, as long as one of the engaging rods 321 may be removably mounted to the front leg rods 311 and the other one of the engaging rods 321 may be removably mounted to the rear leg rods 311, the configurations of the wall engaging portions 325 and the configuration of the board engaging portions 313 may be switched (e.g., each of the board engaging portions 313 includes two engaging members, and each of the wall engaging portions 325 is a hole that may removably engage any one of the engaging members). Moreover, in one embodiment, as long as one of the engaging rods 321 may be removably mounted to the front leg rods 311 and the other one of the engaging rods 321 may be removably mounted to the rear leg rods 311, each of the wall engaging portions 325 may include only one wall engaging member 326 (i.e., if the configurations of the wall engaging portions 325 and the configuration of the board engaging portions 313 are switched, each of the board engaging portions 313 includes one engaging member).

Furthermore, in the first embodiment, the engaging rods 321 that are spaced apart from each other in the front-rear direction and that extend in the left-right direction engaging rods 321 are spaced apart from each other in the front-rear direction and extend in the left-right direction, and one of the engaging rods 321 is removably mounted to the front leg rods 311 and the other one of the engaging rods 321 is removably mounted to the rear leg rods 311. For each leg rod 311, each of the board engaging portions 313 is configured to be a hole that extends through the leg rod 311 in the front-rear direction. However, in one embodiment, the engaging rods 321 may be spaced apart from each other in the left-right direction, may extend in the front-rear direction, and may be removably mounted to the leg pairs, respectively. For each leg rod 311, each of the board engaging portions 313 may be a hole that extends through the leg rod 311 in the left-right direction.

It should be noted that, in the first embodiment, the shelf device 300 includes two shelf units 3 that are stacked in the up-down direction and that are fastened by four fastening units 4. However, in one embodiment, the shelf device 300 may include more than two shelf units 3 and more than four fastening units 4. For example, the shelf device 300 may include eight fastening units 4 and three shelf units 3 that are stacked in the up-down direction and that are fastened by the fastening units 4 (i.e., the middle shelf unit 3 is fastened to the bottom shelf unit 3 by four of the fastening units 4 and is fastened to the top shelf unit 3 by the other four of the fastening units 4).

Figure 4:
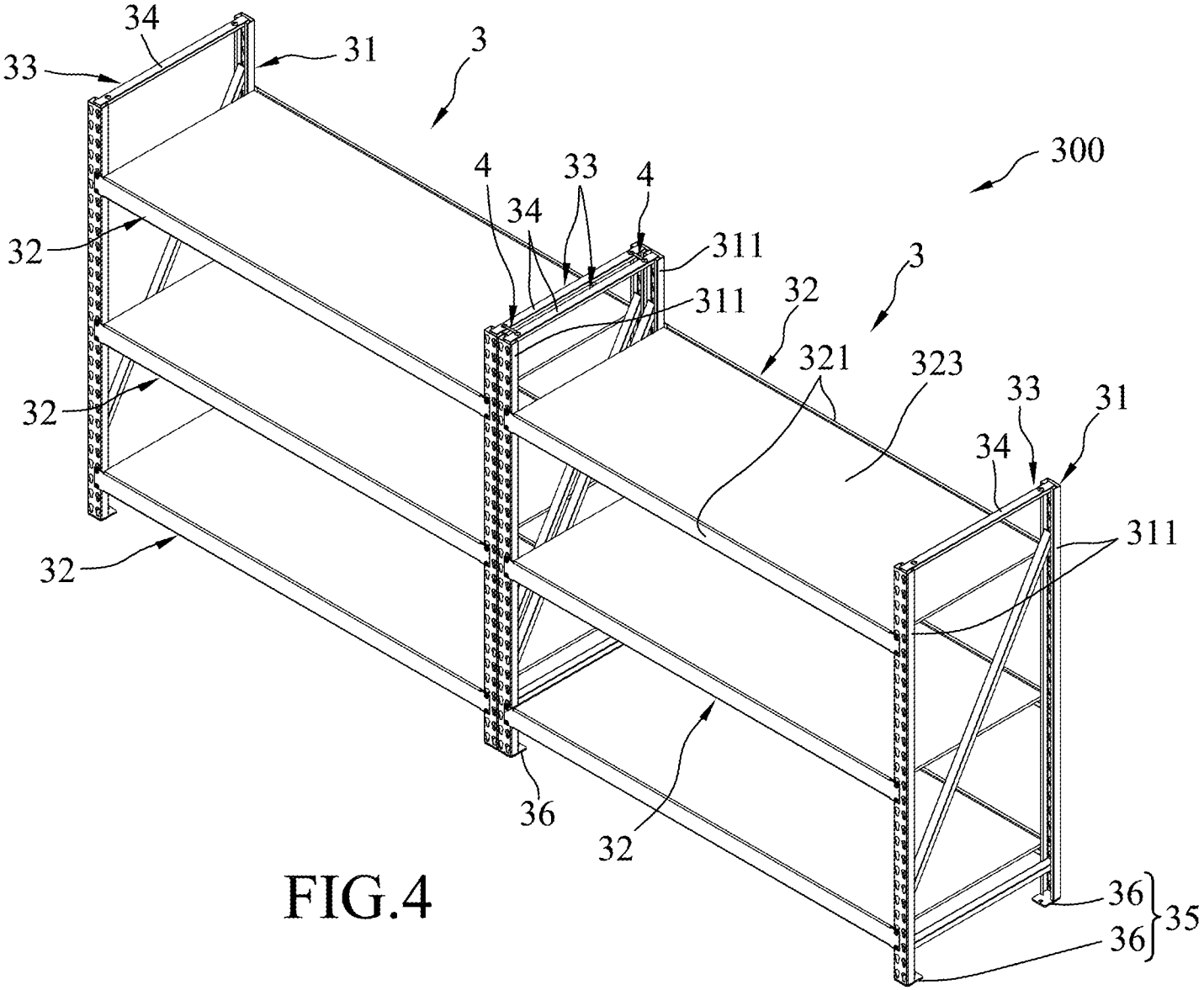
FIG. 4 is a perspective view of a second embodiment of the shelf device according to the disclosure.
Figure 5:
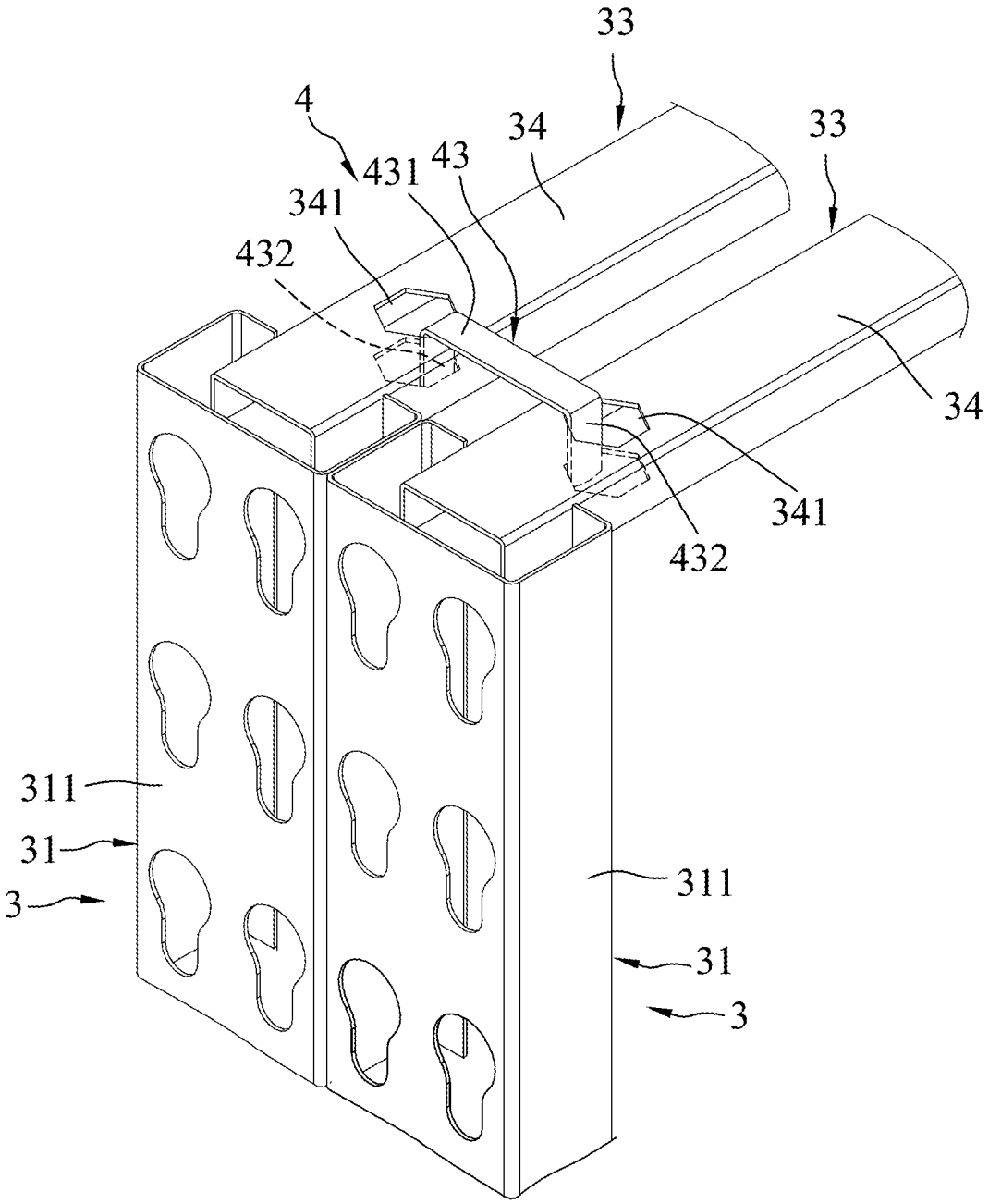
FIG. 5 is a fragmentary perspective view of the second embodiment.
Figure 6:
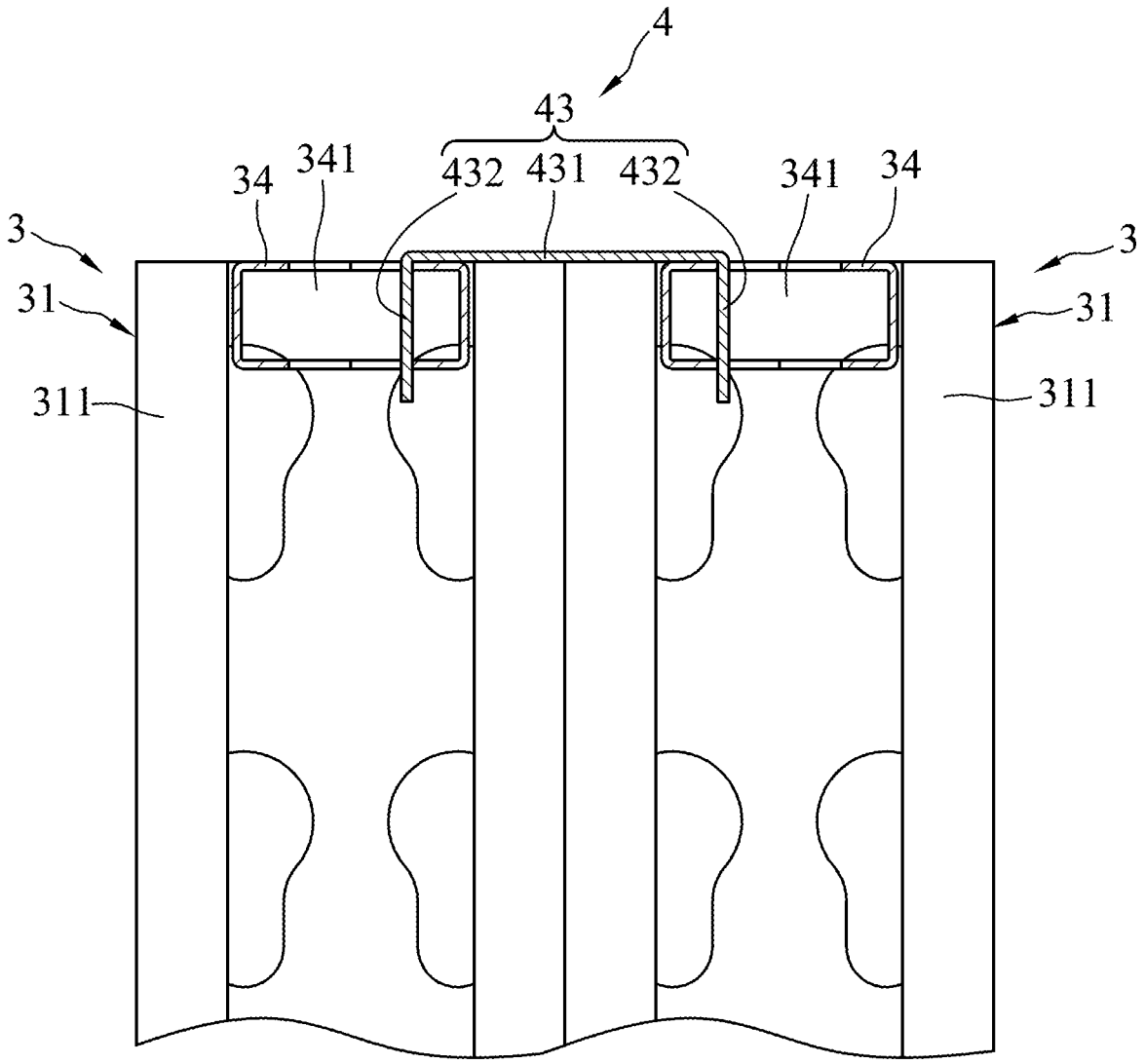
FIG. 6 is a fragmentary sectional view of the second embodiment.

Referring to FIGS. 4 to 6, a second embodiment of the shelf device 300 includes two shelf units 3 that are arranged and fastened differently from the first embodiment, and different configurations of the fastening units 4. For convenience of the description, only the differences between the first and second embodiments will be described below.

In the second embodiment, the shelf device 300 includes two shelf units 3 that are arranged side by side in the left-right direction, and two fastening units 4. Specifically, one of the leg pairs of one of the shelf units 3 is adjacent to one of the leg pairs of the other one of the shelf units 3 so that the shelf units 3 are arranged side by side. The assembly mechanisms 33 of each of the shelf units 3 are respectively mounted to the leg pairs of the shelf unit 3 such that when the shelf units 3 are arranged side by side, the first connecting subunit 34 of one of the assembly mechanisms 33 of one of the shelf units 3 is adjacent to the first connecting subunit 34 of one of the assembly mechanisms 33 of the other one of the shelf units 3. Specifically, the engaging holes 341 of the first connecting subunit 34 of the one of the assembly mechanisms 33 of the one of the shelf units 3 are juxtaposed with the engaging holes 341 of the one of the assembly mechanisms 33 of the other one of the shelf units 3 in the left-right direction. The fastening units 4 are spaced apart from each other. Each of the fastening units 4 is disposed on the first connecting subunits 34 of the adjacent assembly mechanisms 33 of the shelf units 3 so that the shelf units 3 are positioned side by side. Since the structure of each of the shelf units 3 in the second embodiment is the same as that of each of the shelf units 3 disclosed in the first embodiment, there will be no further description for the shelf units 3.

Each of the fastening units 4 includes a side fastening member 43 that is mounted to a respective one of the engaging holes 341 of one of the adjacent assembly mechanisms 33 and a respective one of the engaging holes 341 of the other one of the adjacent assembly mechanisms 33 juxtaposed with the respective one of the engaging holes 341 of the one of the adjacent assembly mechanisms 33.

Each of the side fastening member 43 has an interconnecting portion 431 that extend in the left-right direction from a top side of the first connecting subunit 34 of the one of the adjacent assembly mechanisms 33 to a top side of the first connecting subunit 34 of the other one of the adjacent assembly mechanisms 33, and two inserting portions 432 that extend downwardly and respectively from two ends of the interconnecting portion 431 and that are respectively inserted into the respective one of the engaging holes 341 of the one of the adjacent assembly mechanisms 33 and the respective one of the engaging holes 341 of the other one of the adjacent assembly mechanisms 33.

When assembling the shelf device 300, the user may juxtapose one of the leg pairs of one of the shelf units 3 and one of the leg pairs of the other one of the shelf units 3 in the left-right direction, and then insert each of the side fastening member 43 into the respective one of the engaging holes 341 of the first connecting subunit 4 that is mounted to the top end of the one of the leg pairs of the one of the shelf units 3, and into the respective one of the engaging holes 341 of the first connecting subunit 4 that is mounted to the top end of the one of the leg pairs of the other one of the shelf units 3. After the side fastening members 43 are inserted into the shelf units 3, the shelf units 3 are arranged side by side in the left-right direction and are fastened.

It should be noted that, in either one of the first embodiment and the second embodiment, each of the shelf units 3 includes three board mechanisms 32. However, in one embodiment, each of the shelf unit 3 may only include one board mechanism 32 according to actual requirements. In addition, the board body 323 of each of the board mechanisms 32 may be, but not limited to, a wire board (see FIG. 1) made of a metal material, or a wooden plate (see FIG. 4).

It is noted that, by virtue of the board engaging portions 313 of each of the leg rods 311 being spaced apart from each other in the up-down direction, when the user assembles any one of the shelf units 3, the user may adjust height of each of the board mechanisms 32 according to the actual requirements by mounting the engaging rods 321 of each of the board mechanisms 32 to the board engaging portions 313 at different heights.

In summary, by virtue of the first and second connecting subunits 34, 35 and the fastening units 4, the shelf units 3 may be stably stacked in the up-down direction, or may be stably arranged side by side in the left-right direction, which is relatively user-friendly, and which may help the user to improve space utilization. Therefore, the purpose of the disclosure is achieved. In one embodiment, the shelf device 300 may include a plurality of shelf units 3 that are fastened together to form a shelf-units array (e.g., 2×2, 2×3, 3×3 . . . ).

Furthermore, by virtue of the first fastening member 41 of each of the fastening units 4 being irrotatably mounted to the respective one of the engaging holes 341, the user may rotate the second fastening member 42 of the fastening unit 4 bare-handedly to urge each of the second fastening members 42 to be threadedly connected to the respective one of the first fastening members 41 so that the shelf units 3 are fastened in the up-down direction. Therefore, the assembly of the shelf device 3 is relatively simple and easy to understand. By virtue of the board engaging portions 313 of each of the leg rods 311 being spaced apart from each other in the up-down direction, it is relatively easy for the user to adjust the height of each of the board mechanisms 32, which allows for much flexibility in arrangement of the board mechanisms 32 in each of the shelf units 3.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A shelf device, comprising:

two shelf units stacked in an up-down direction, each of the shelf units including a leg rod mechanism that includes four leg rods extending in the up-down direction and spaced apart from each other, the leg rods being equally divided into two leg pairs, a board mechanism that is mounted among the leg rods, and two assembly mechanisms that are respectively mounted to the leg pairs, each of the assembly mechanisms including a first connecting subunit that is mounted to a top end of the respective one of the leg pairs, and a second connecting subunit that is mounted to a bottom end of the respective one of the leg pairs, one of the first connecting subunit and the second connecting subunit of each of the assembly mechanisms having two engaging holes each of which extends therethrough in the up-down direction and is configured to be non-circular, the other one of the first connecting subunit and the second connecting subunit of each of the assembly mechanisms having two through holes each of which extends therethrough in the up-down direction and corresponds in position to a respective one of the engaging holes of the assembly mechanism in the up-down direction, the leg rods of one of the shelf units being connected to and being located on the leg rods of the other one of the shelf units, the engaging holes of one of the shelf units being respectively aligned with the through holes of the other one of the shelf units in the up-down direction; and four fastening units each of which is mounted to a respective one of the engaging holes of the one of the shelf units and a respective one of the through holes of the other one of the shelf units that are aligned in the up-down direction, each of the fastening units including a first fastening member that is irrotatably mounted to the respective one of the engaging holes, and a second fastening member that extends through the respective one of the through holes and the respective one of the engaging holes and that is removably connected to the first fastening member so that the shelf units are fastened in the up-down direction.

2. The shelf device as claimed in claim 1, wherein each of the first connecting subunits of the shelf units is elongated, extends horizontally from a top end of one of the leg rods in the respective leg pair to a top end of the other one of the leg rods in the respective leg pair, and has the engaging holes, each of the second connecting subunits of the shelf units including two plate bodies that respectively extend horizontally from the leg rods in the respective leg pair toward each other, the plate bodies respectively having the through holes.

3. The shelf device as claimed in claim 2, wherein each of the first fastening members of the fastening units has an abutting portion that abuts against a bottom side of one of the first connecting subunits, and a fastening portion that extends upwardly from the abutting portion and that is irrotatably coupled to the respective one of the engaging holes, each of the second fastening members having a threaded rod portion that extends through the respective one of the through hole and that is threadedly connected to the fastening portion of a respective one of the first fastening members, and an operation portion that is connected to a top end of the threaded rod portion and that is operable to urge the threaded rod portion to be threadedly connected to the fastening portion of the respective one of the first fastening members.

4. The shelf device as claimed in claim 1, wherein each of the leg rods has an engaging wall that extends in the up-down direction and that has a plurality of board engaging portions spaced apart from each other in the up-down direction, the board mechanism of each of the shelf units including two engaging rods and a board body, one of the engaging rods of each of the shelf units being removably mounted to two of the leg rods of the shelf unit, the other one of the engaging rods of each of the shelf units being removably mounted to the other two of the leg rods of the shelf unit, the board body of the board mechanism of each of the shelf units being removably supported on the engaging rods of the shelf unit, each of the engaging rods of the board mechanism of each of the shelf units having a supporting portion that supports the board body of the shelf unit, and two wall engaging portions that are disposed on the supporting portion, one of the wall engaging portions of each of the engaging rods removably engaging one of the board engaging portions of one of the leg rods to which the engaging rod is mounted, the other one of the wall engaging portions of each of the engaging rods removably engaging one of the board engaging portions of the other one of the leg rods to which the engaging rod is mounted.

5. The shelf device as claimed in claim 4, wherein the board mechanism of each of the shelf units further includes a reinforcing rod that is located between the engaging rods thereof.

* * * * *